US006165042A

United States Patent [19]

Chin

[11] Patent Number: 6,165,042

[45] Date of Patent: Dec. 26, 2000

[54] BOB TOY DEVICE

[76] Inventor: Lin-Chi Chin, 58, Ma Yaun West St., Taichung, Taiwan

[21] Appl. No.: 09/189,910

[22] Filed: Nov. 10, 1998

[51] Int. Cl.[7] ..... A63H 1/24

[52] U.S. Cl. ..... 446/292; 446/485

[58] Field of Search ..... 446/236, 292, 446/297, 485

[56] References Cited

U.S. PATENT DOCUMENTS

| | | | |
|---|---|---|---|
| 3,162,979 | 12/1964 | Garoogian | 446/242 |
| 3,191,344 | 6/1965 | Yagjian | 446/242 |
| 3,452,474 | 7/1969 | Zopf | 446/242 |
| 3,745,697 | 7/1973 | Wang | 446/242 |
| 4,178,714 | 12/1979 | Tsen et al. | 446/242 |
| 4,327,518 | 5/1982 | Knauff | 446/242 |
| 4,867,727 | 9/1989 | Lanius | 446/242 |
| 5,145,444 | 9/1992 | Van Kuiken | 446/242 |
| 5,356,328 | 10/1994 | Ho | 446/250 X |

*Primary Examiner*—Sam Rimell

[57] ABSTRACT

A bob toy device has a male disk, a female disk, a hollow bobbin disposed between the male disk and the female disk, a first cover disposed on the male disk, a generally T-shaped block disposed in the female disk, a second cover disposed on the female disk, and a shaft passing through the first cover, the male disk, the hollow bobbin, the female disk, the generally T-shaped block, and the second cover.

2 Claims, 6 Drawing Sheets

BOB TOY DEVICE

BACKGROUND OF THE INVENTION

The present invention relates to a bob toy device. More particularly, the present invention relates to a bob toy device which is easily detached.

A conventional bob toy device has a clutch device. However, the clutch device has a very complex structure so that it is difficult to assemble the conventional bob toy device. Furthermore, the conventional bob toy device cannot be detached by the user to replace a broken element of the conventional bob toy device.

SUMMARY OF THE INVENTION

An object of the present invention is to provide a bob toy device which is easily detached.

Another object of the present invention is to provide a bob toy device which has an illuminator to glitter.

Accordingly, a bob toy device comprises a male disk, a female disk, a hollow bobbin disposed between the male disk and the female disk, a first cover disposed on the male disk, a generally T-shaped block disposed in the female disk, a second cover disposed on the female disk, and a shaft passing through a center aperture of the first cover, a center hole of the male disk, the hollow bobbin, a round central hole of the female disk, the generally T-shaped block, and a round central aperture of the second cover. The male disk has the center hole, at least a first rod, a second rod, a third rod, a plurality of hollow posts, and three inner notches. The first cover has the center aperture, three lugs, three reinforced bars, a plurality of hollow pillars, two block plates, and a block post. The hollow pillars engage with the hollow posts. The female disk has the round central hole, a plurality of positioning bars, a plurality of hollow columns, and three inner grooves. Three compression springs are disposed between the female disk and the generally T-shaped block. The second cover has the round central aperture, a plurality of tubes, three lobes, and three reinforced ribs. The tubes engage with the hollow columns. The inner notches receive the lugs. The inner grooves receive the lobes.

DETAILED DESCRIPTION OF THE INVENTION

Figure 1:
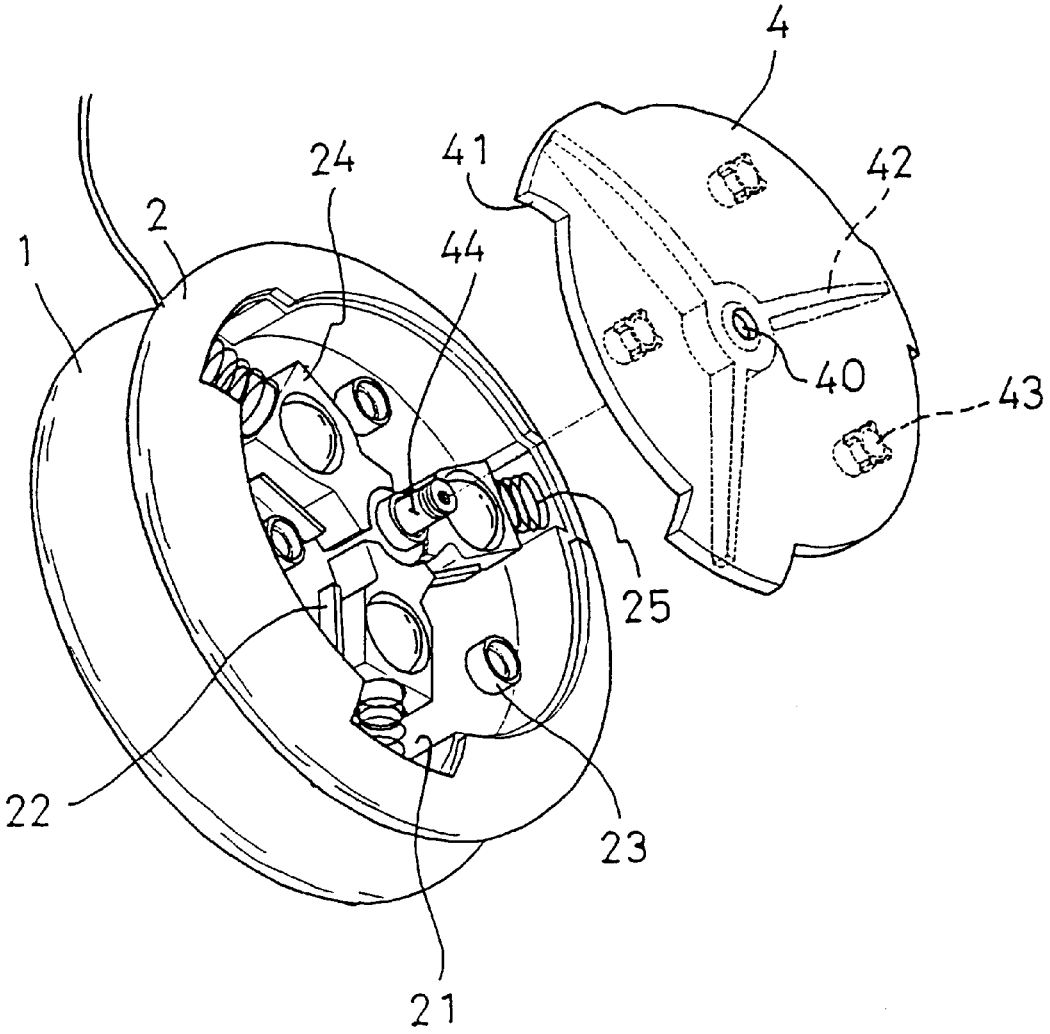
FIG. 1 is a perspective view of a bob toy device of a preferred embodiment in accordance with the present invention.
Figure 2:
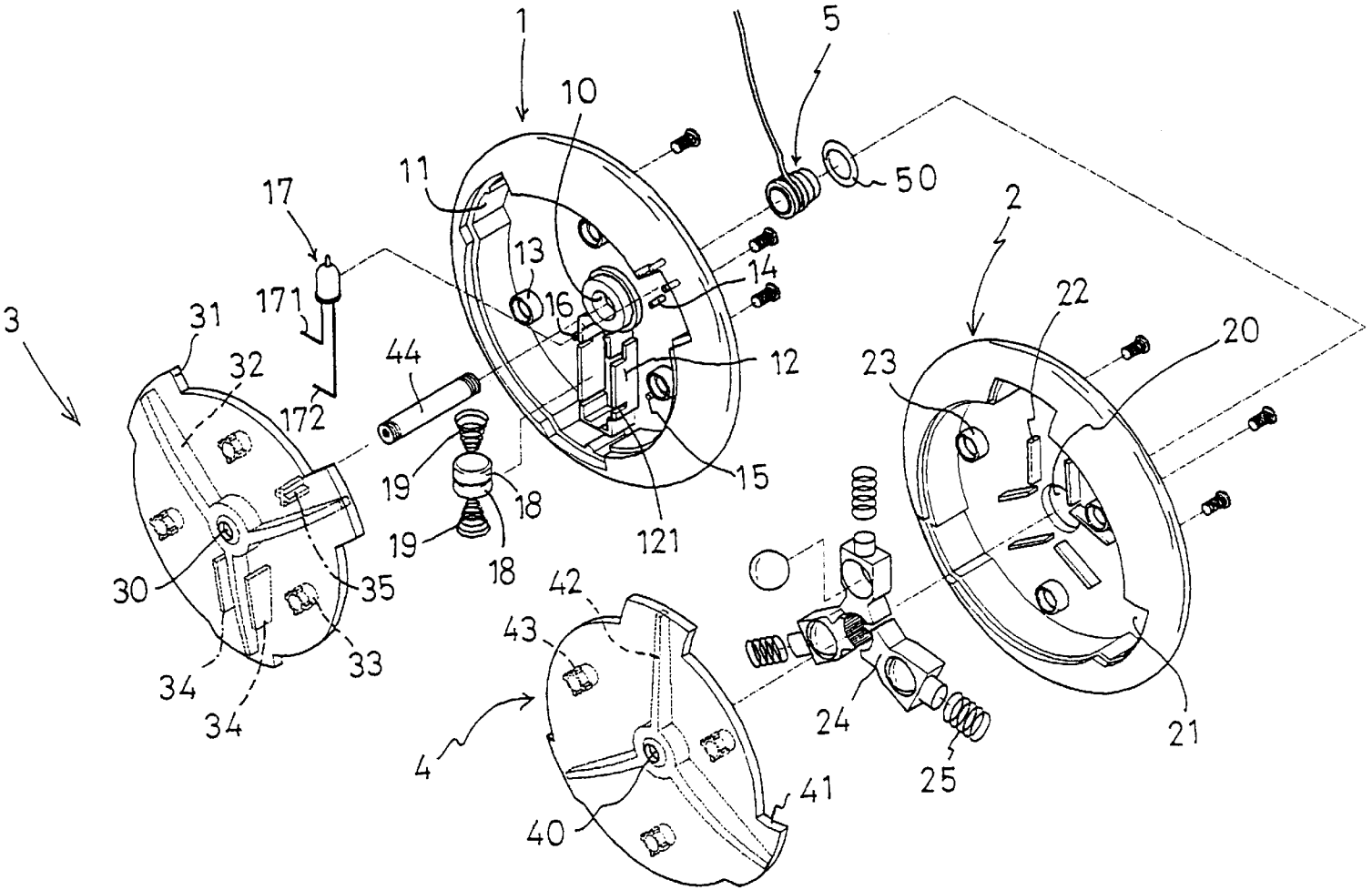
FIG. 2 is a perspective exploded view of a bob toy device of a preferred embodiment in accordance with the present invention.
Figure 3:
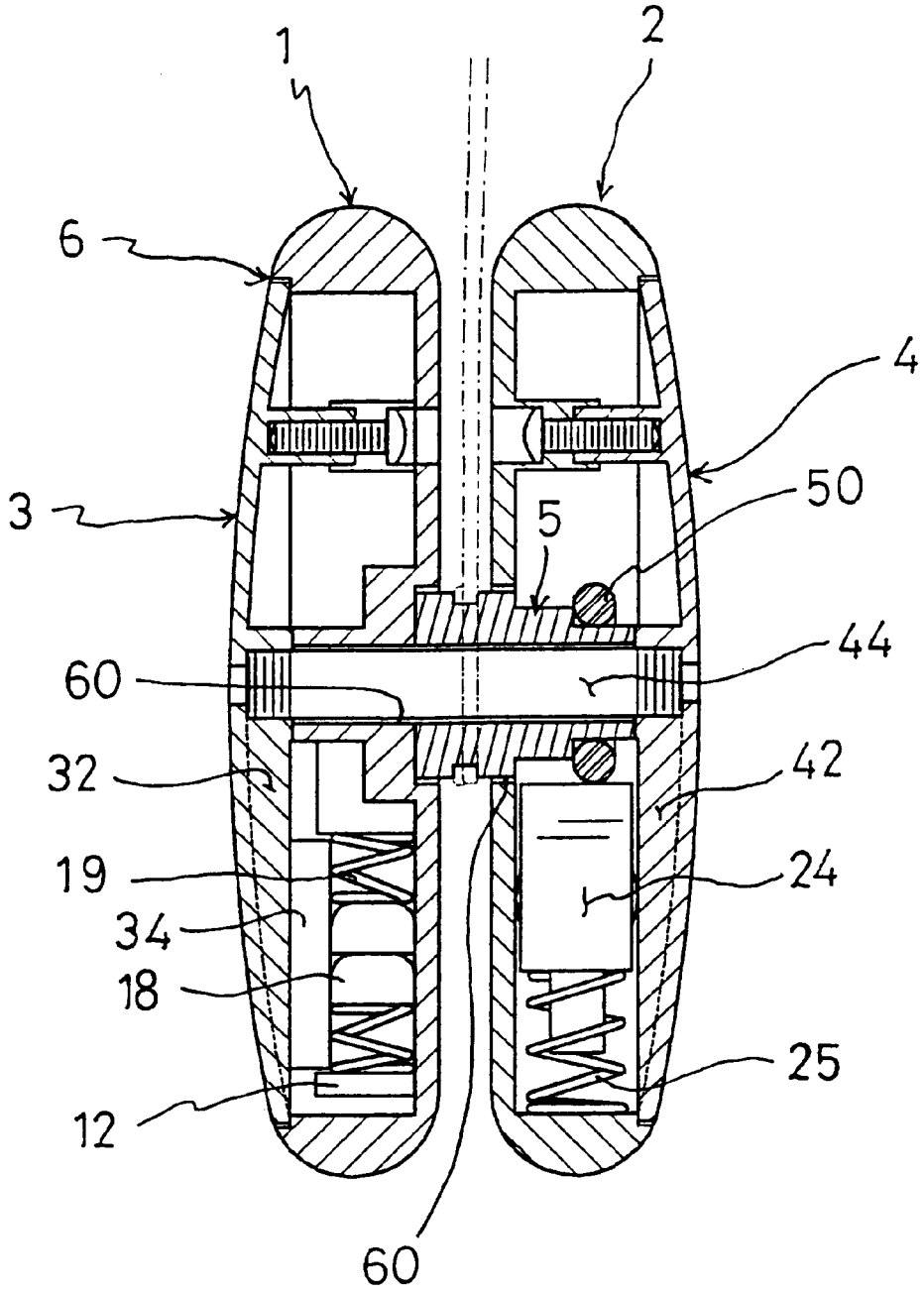
FIG. 3 is a sectional assembly view of a bob toy device of a preferred embodiment in accordance with the present invention.
Figure 4:
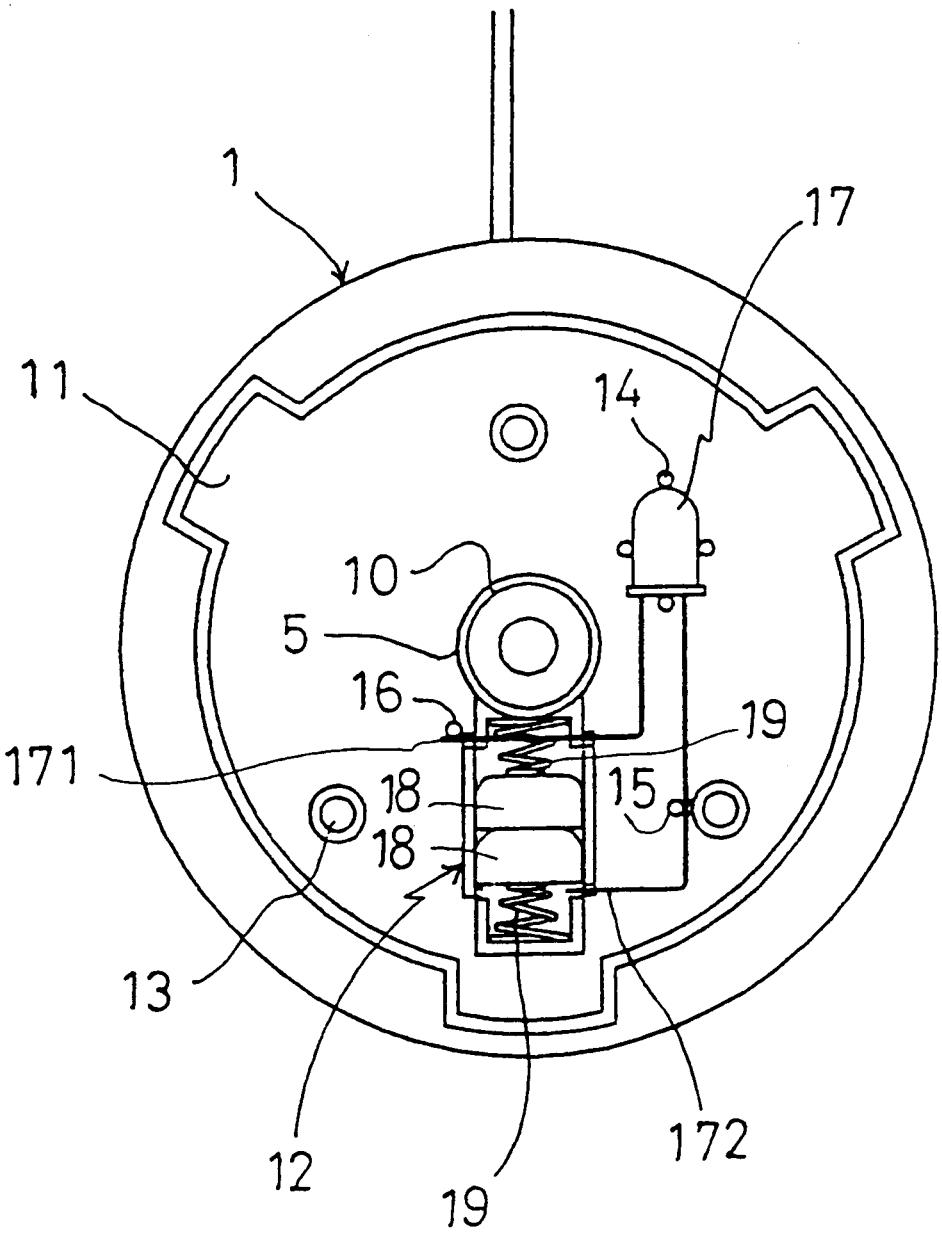
FIG. 4 is an elevational view of a bob toy device of a preferred embodiment without a first cover and a second cover.

Referring to FIGS. 1 to 4, a bob toy device comprises a male disk 1, a female disk 2, a hollow bobbin 5 disposed between the male disk 1 and the female disk 2, a first cover 3 disposed on the male disk 1, a generally T-shaped block 24 disposed in the female disk 2, a second cover 4 disposed on the female disk 2, and a shaft 44 passing through a center aperture 30 of the first cover 3, a center hole 10 of the male disk 1, the hollow bobbin 5, a round central hole 20 of the female disk 2, the generally T-shaped block 24, and a round central aperture 40 of the second cover 4. A string winds the hollow bobbin 5.

The male disk 1 has the center hole 10, at least a first rod 14, a second rod 15, a third rod 16, a plurality of hollow posts 13, and three inner notches 11.

The first cover 3 has the center aperture 30, three lugs 31, three reinforced bars 32, a plurality of hollow pillars 33, two block plates 34, and a block post 35. The hollow pillars 33 engage with the hollow posts 13.

The female disk 2 has the round central hole 20, a plurality of positioning bars 22, a plurality of hollow columns 23, and three inner grooves 21.

Three compression springs 25 are disposed between the female disk 2 and the generally T-shaped block 24.

The second cover 4 has the round central aperture 40, a plurality of tubes 43, three lobes 41, and three reinforced ribs 42.

The tubes 43 engage with the hollow columns 23. The inner notches 11 receive the lugs 31. The inner grooves 21 receive the lobes 41.

The male disk 1 further has a chamber 12 to receive at least a cell 18, two conductive springs 19, and an illuminator 17. The illuminator 17 has a first conductive wire 171 and a second conductive wire 172. The cell 18 is disposed between the conductive springs 19.

A rubber washer 50 surrounds the hollow bobbin 5. A clearance 6 is formed between the lug 31 and the male disk 1. A spacing 60 is formed between the hollow bobbin 5 and one of the male disk 1 and the female disk 2.

Figure 5:
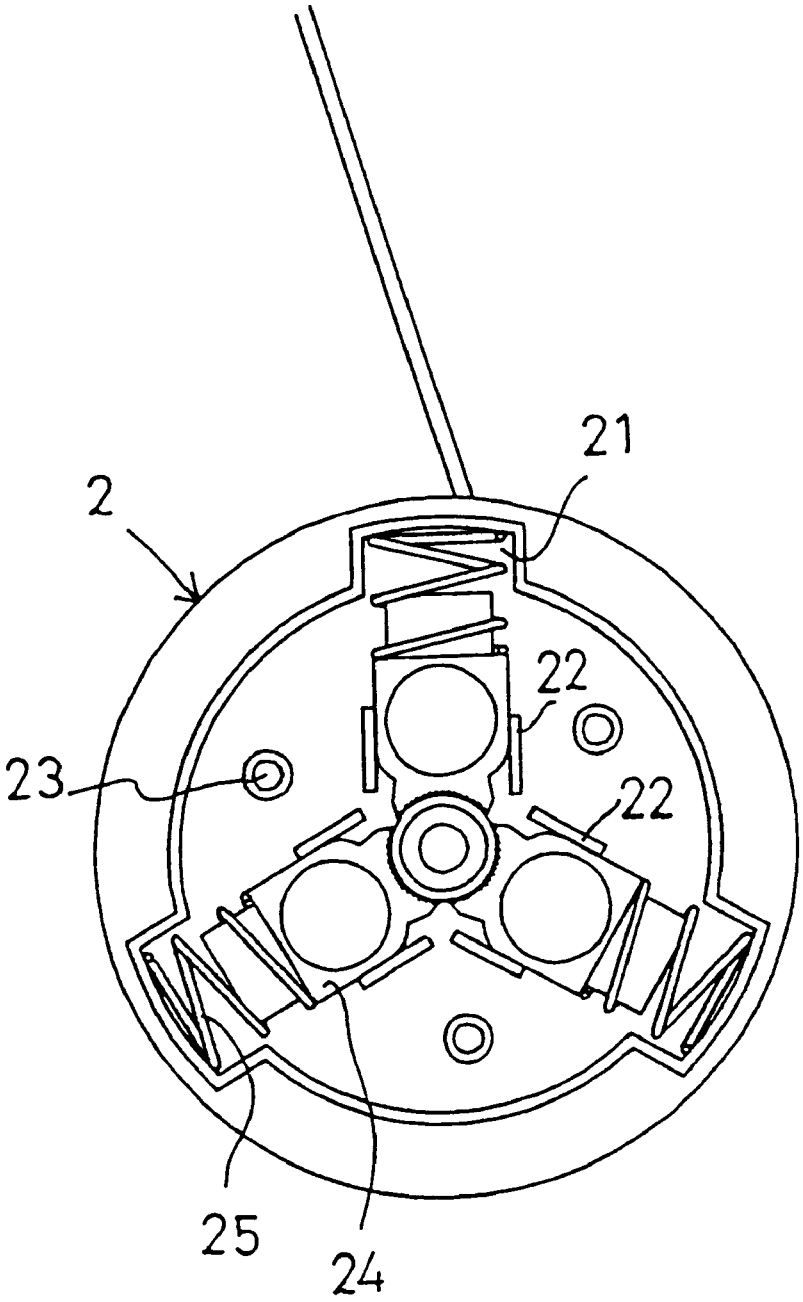
FIG. 5 is a first schematic view illustrating an operation of a bob toy device of a preferred embodiment in accordance with the present invention.

Referring to FIG. 5, the hollow bobbin 5 engages with the generally T-shaped block 24. Then the string is extended.

Figure 6:
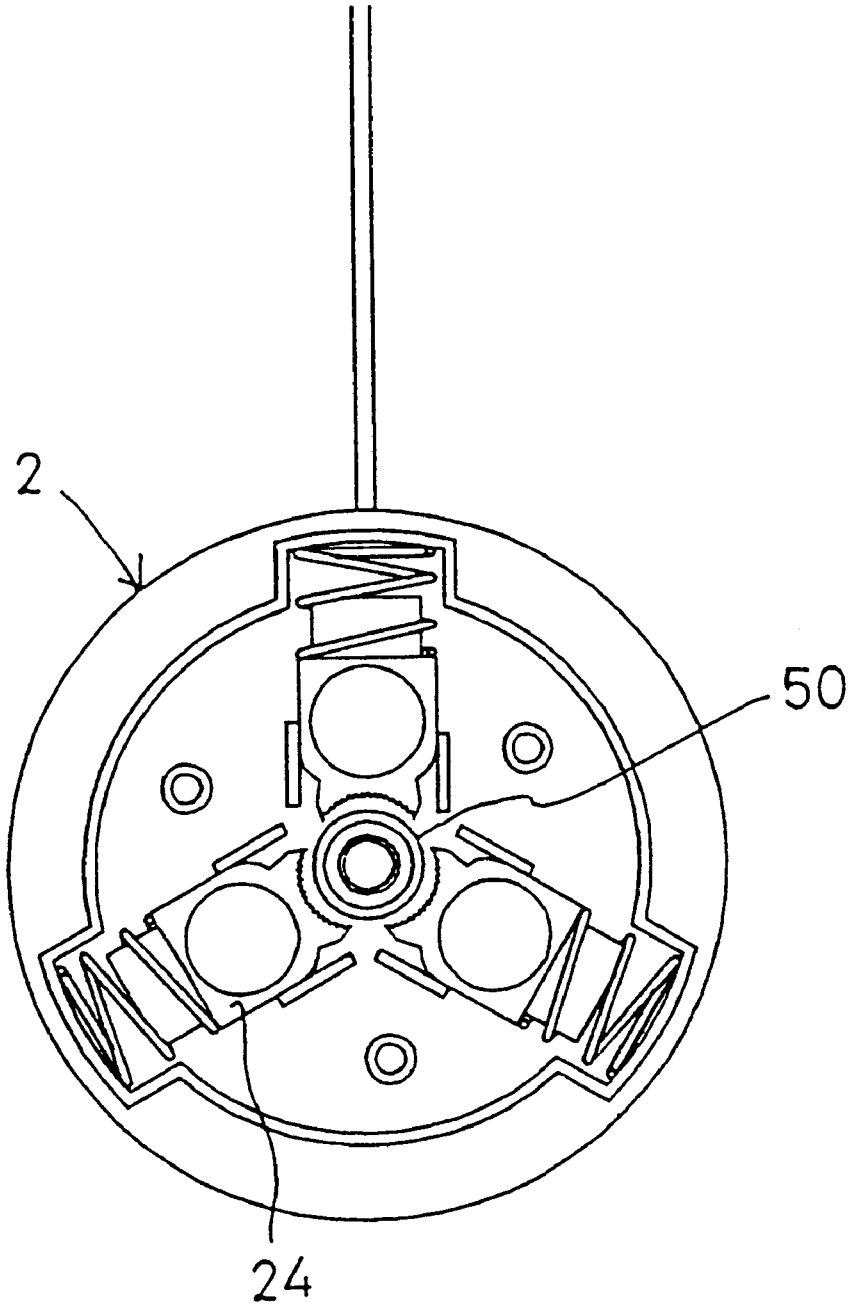
FIG. 6 is a second schematic view illustrating an operation of a bob toy device of a preferred embodiment in accordance with the present invention.

Referring to FIG. 6, the hollow bobbin 5 disengages from the generally T-shaped block 24. Then the bob toy device rotates idly.

The invention is not limited to the above embodiment but various modification thereof may be made. Further, various changes in form and detail may be made without departing from the scope of the invention.

I claim:

1. A bob toy device comprising:

a male disk, a female disk, a hollow bobbin disposed between the male disk and the female disk, a first cover disposed on the male disk, a generally T-shaped block disposed in the female disk, a second cover disposed on the female disk, a shaft passing through a center aperture of the first cover, a center hole of the male disk, the hollow bobbin, a round central hole of the female disk, the generally T-shaped block, and a round central aperture of the second cover, the male disk having the center hole, at least a first rod, a second rod, a third rod, a plurality of hollow posts, and three inner notches, the first cover having the center aperture, three lugs, three reinforced bars, a plurality of hollow pillars, two block plates, and a block post, the hollow pillars engaging with the hollow posts, the female disk having the round central hole, a plurality of positioning bars, a plurality of hollow columns, and three inner grooves, three compression springs disposed between the female disk and the generally T-shaped block, the second cover having the round central aperture, a plurality of tubes, three lobes, and three reinforced ribs, the tubes engaging with the hollow columns, the inner notches receiving the lugs, the inner grooves receiving the lobes, a rubber washer surrounding the hollow bobbin, a clearance formed between the lug and the male disk, and a spacing formed between the hollow bobbin and one of the male disk and the female disk.

2. A bob toy device as claimed in claim 1, wherein the male disk further has a chamber to receive at least a cell, two conductive springs, and an illuminator, the illuminator has a first conductive wire and a second conductive wire, and the cell is disposed between the conductive springs.

* * * * *